US006878497B2

(12) United States Patent
Kameoka

(10) Patent No.: US 6,878,497 B2
(45) Date of Patent: Apr. 12, 2005

(54) TONER ADDITIVE, ELECTROSTATIC IMAGE DEVELOPING TONER AND ELECTROSTATIC IMAGE DEVELOPER

(75) Inventor: Taiji Kameoka, Kuga-Gun (JP)

(73) Assignee: Mitsui Chemicals, Inc., Tokyo (JP)

( * ) Notice: Subject to any disclaimer, the term of this patent is extended or adjusted under 35 U.S.C. 154(b) by 0 days.

(21) Appl. No.: 10/448,195

(22) Filed: May 30, 2003

(65) Prior Publication Data

US 2003/0207995 A1 Nov. 6, 2003

Related U.S. Application Data

(62) Division of application No. 09/786,780, filed as application No. PCT/JP00/04748 on Jul. 14, 2000, now Pat. No. 6,582,865.

(30) Foreign Application Priority Data

Jul. 16, 1999 (JP) ..... 11-203554

(51) Int. Cl.[7] ..... G03G 9/097

(52) U.S. Cl. ..... 430/108.1; 430/137.18

(58) Field of Search ..... 430/108.1, 108.8, 430/109.3, 137.2, 137.18, 109.4; 526/347, 347.1

(56) References Cited

U.S. PATENT DOCUMENTS 4,238,376 A 12/1980 Wilson
4,486,524 A * 12/1984 Fujisaki et al. ..... 430/109.3
4,762,878 A 8/1988 Takeda et al.
5,854,367 A 12/1998 Salvetat et al.
5,958,642 A 9/1999 Takagi et al.
5,972,547 A 10/1999 Yaguchi et al.

FOREIGN PATENT DOCUMENTS

JP 11-052615 A 2/1999

* cited by examiner

*Primary Examiner*—Janis L. Dote
(74) *Attorney, Agent, or Firm*—Burns, Doane, Swecker & Mathis, LLP

(57) ABSTRACT

A toner additive comprising a polymer of at least one monomer selected from the group consisting of vinyltoluene, α-methyl styrene and isopropenyl toluene, which has a ring and ball softening point of 130–170° C., or a copolymer of styrene and at least one kind of monomer selected from the above group which has a ring and ball softening point of 110–170° C. By adding such toner additive to a toner, an electrostatic image developing toner which has excellent pulverizability in the pulverizing process and does not fuse to equipment can be obtained. In addition, such toner additive does not affect the fundamental performances of a toner such as electrostatic performance, fixing performance, color, etc. Therefore, an electrostatic image developing toner and electrostatic image developer capable of producing a high quality image can be obtained at a low cost.

12 Claims, No Drawings

TONER ADDITIVE, ELECTROSTATIC IMAGE DEVELOPING TONER AND ELECTROSTATIC IMAGE DEVELOPER

This application is a division of application Ser. No. 09/786,780 filed on Mar. 9, 2001, now U.S. Pat. No. 6,582,865 B1, which was a national phase filing under 35 U.S.C. §371 of International Application No. PCT/JP00/04748 filed Jul. 14, 2000.

FIELD OF THE INVENTION

The present invention relates to a toner additive for electrostatic image developing, to a toner for electrostatic image developing, and to an electrostatic image developer used in the electrophotographic method, in the electrostatic recording method, in the electrostatic printing method or the like.

BACKGROUND OF THE INVENTION

A toner for electrostatic image developing is generally manufactured through the following processes: the process for mixing binding resins and coloring agents with various additives added as needed; the process for melting and kneading the mixture using a kneading machine; the process for roughly grinding the kneaded and cooled mixture into a grain size of about several millimeters; the process for pulverizing the roughly ground material into a grain size of about several microns using the impact of collisions and the like; the process for classifying the pulverized material; the process for adding and mixing additives such as fluidizing agents and transcription auxiliaries to the material; and the process for removing bulky grains generated in the processes for mixing and the like. Recently, the grain size of toners has become increasingly finer so as to realize images of higher quality and the use of polyester resins as binding resin has increased so as to secure low-temperature fixity.

Because of the technical trend described above, a longer time is now required for the pulverizing process, which is originally a rate-controlling process, causing a fall in productivity. Pulverizers have been remodeled so as to improve grindability, but this method for improving productivity tends to increase the manufacturing cost owing to larger pulverizer size and higher energy consumption. The situation requires improvement in the grindability of the materials.

In order to solve these problems, there are methods for changing the component monomers of the binding resins or for reducing the molecular weight thereof. These methods, however, lower the softening point or glass-transition point of the toner although they improve the grindability thereof. As a result, the toner becomes apt to adhere to the interior of the pulverizer or classifier, or to the inside of the piping connecting them, or even to fuse therewith, affecting the manufacturing conditions. This also considerably affects the electrostatic properties or fixing properties of the toner. These methods realize good grindability at the sacrifice of much.

A material for improving grindability is known as another method. For example, a technique for making grindability compatible with fixing performance by using aromatic petroleum resins is described in Japanese Patent Kokai Hei 4-257868A. However, such aromatic petroleum resins as described in the official gazette are not satisfactory enough regarding color reproducibility, transparency, and the like when used as a part of the toner component because the material of these aromatic petroleum resins is made from a fraction which is a mixture of mainly styrene, vinyltoluene, α-methyl styrene, indene, diisobutylene, toluene, n-octane, xylene, p-ethyltoluene, dicyclopentadiene, β-methyl styrene, and naphthalene out of the decomposed oil fraction, a by-product from ethylene plants for producing ethylene, propylene and the like by steam cracking of petroleum, and as oligomers of which aromatic petroleum resins are generally colored.

A toner for electrostatic image developing which comprises at least a binding resin, a coloring agent, and a copolymerized resin containing at least one monomer based on styrene and one monomer based on indene is described in Japanese Patent Kokai Hei 11-65161A (corresponding to U.S. Pat. No. 5,972,547). However, as monomers based on indene are generally apt to get colored, the copolymerized resins thereof are also prone to get colored. Consequently, the toner disclosed in the official gazette is not satisfactory enough regarding color reproducibility and transparency. Besides, monomers based on indene must be refined to the extent of exceedingly high purity if the manufacture of non-colored copolymerized resins thereof is intended. Naturally, this requires special equipment, causing the problem of higher manufacturing cost.

Furthermore, a toner for electrostatic image developing which contains coloring agents, binding resins, and a copolymerized petroleum resin of aliphatic hydrocarbon with aromatic hydrocarbon having more than 9 carbon atoms is described in Japanese Patent Kokai Hei 11-72956 (corresponding to U.S. Pat. No. 5,958,642). Although the toner disclosed in the official gazette improves the grindability, heat preservability, and the dispersibility of the mold release agent, it does not realize satisfactory electrostatic properties.

An object of the present invention is to provide a toner additive which realizes an electrostatic image developing toner having good grindability in the pulverizing process and consequently making it possible to reduce the grain size easily in a short time, which causes no fusion with the equipment, and which does not affect the fundamental toner performances such as electrostatic performance, fixing performance, and coloring performance.

Another object of the present invention is to provide an electrostatic image developing toner and an electrostatic image developer, both containing said toner additive.

DISCLOSURE OF THE INVENTION

The above objects are achieved by using a pulverizing auxiliary which does not change the rheology of the binding resins. The present invention provides a toner additive to be used as the pulverizing auxiliary. That is, the present invention relates to the following toner additive, electrostatic image developing toner, and electrostatic image developer.

(1) A toner additive, comprising:

a polymer comprising at least one monomer selected from the group consisting of vinyltoluene, α-methyl styrene, and isopropenyl toluene, and having a ring and ball softening point of 130–170° C., or a copolymer comprising styrene and at least one monomer selected from the group consisting of vinyltoluene, α-methyl styrene, and isopropenyl toluene, and having a ring and ball softening point of 110–170° C.

(2) An electrostatic image developing toner comprising:

1–20 parts by weight of the toner additive as defined in the above (1) and 100 parts by weight of binding resin.

(3) An electrostatic image developing toner as defined in the above (2), wherein the binding resin is polyester resin.

(4) An electrostatic image developer comprising at least one toner and one carrier, wherein said toner is an electrostatic image developing toner as defined in the above (2) or (3).

(5) An electrostatic image developer as defined in the above (4), wherein the carrier has a resin coating layer.

BEST MODE FOR CARRYING OUT THE INVENTION

The toner additive according to the present invention comprises a polymer of at least one monomer selected from the group consisting of vinyltoluene, α-methyl styrene, and isopropenyl toluene, and comprises a polymer having a ring and ball softening point (softening point measured by the ring and ball method provided in JIS K 2207) of 130–170° C., preferably of 135–160° C. As the ring and ball softening point of the polymer is in the range of 130–170° C., an electrostatic image developing toner prepared by adding the toner additive according to the present invention (hereinafter simply referred to as 'toner') has excellent low-temperature fixity and electrostatic properties. The polymer may be a homopolymer of vinyltoluene, α-methyl styrene, or isopropenyl toluene, or can be a copolymer of these monomers. Although it is desirable that these polymers are not copolymerized with monomers other than styrene, they may be copolymerized with monomers other than styrene within the scope of not hindering the objects of the present invention (indene monomers and aliphatic hydrocarbons are excepted from the monomers other than styrene).

The polymer used as the toner additive according to the present invention may have styrene copolymerized therewith. The proportion of the styrene content in all monomers composing the copolymer may favorably be 50 mol % or less, and preferably 40–20 mol %. When styrene is copolymerized, the ring and ball softening point of the copolymer is 110–170° C., preferably 115–150° C. As the ring and ball softening point of the copolymer is within the range of 110–170° C., a toner prepared by adding the toner additive according to the present invention has excellent low-temperature fixity and electrostatic properties.

The polymer of at least one monomer selected from the group consisting of vinyltoluene, α-methyl styrene, and isopropenyl toluene, or the copolymer thereof further copolymerized with styrene, both of which are used in the present invention, can be obtained by polymerizing monomers in the presence of a catalyst. As the catalysts used for polymerization, there are those generally known as Friedel-Crafts catalysts such as various complexes of, for example, aluminum chloride, aluminum bromide, dichloro-monoethyl aluminum, titanium tetrachloride, tin tetrachloride, and boron trifluoride. The amount of catalyst to use may favorably be 0.01–5% by weight to the total weight of the monomers, and preferably 0.05–3% by weight.

The polymerization reaction is preferably carried out in at least one hydrocarbon solvent selected from the group consisting of aromatic hydrocarbon, aliphatic hydrocarbon, and alicyclic hydrocarbon so as to remove the heat of reaction or to prevent the reactant mixture from becoming too viscous. As preferable hydrocarbon solvents, there may be enumerated aromatic hydrocarbons such as toluene, xylene, ethylbenzene, mesitylene, cumene, and cymene, or a mixture thereof; or a mixture of these aromatic hydrocarbons with aliphatic hydrocarbons such as pentane, hexane, heptane, and octane and/or alicyclic hydrocarbons such as cyclopentane, cyclohexane, and methylcyclohexane. The preferable amount of these reaction solvents to use is 10–80% by weight as the initial concentration of monomers in a reactant mixture.

The polymerization temperature can be suitably selected according to the kind and amount of monomers or catalyst to be used. Normally, a preferable temperature is −30 to +50° C. The polymerization time is generally about 0.5 to 5 hours. Normally, polymerization is almost complete in 1 to 2 hours.

Either the batch system or continuous system is adoptable as the polymerization form. Multi-stage polymerization can also be used.

Residual catalyst should be removed by washing after polymerization is terminated. Preferable washing solvents are alkaline aqueous solutions of potassium hydroxide or sodium hydroxide dissolved therein or alcohol such as methanol. Washing and deashing using methanol is particularly preferable. Washing is followed by removal of un-reacted monomers and polymerization solvents by vacuum distillation. The polymer or copolymer used in the present invention is obtained in this manner.

The toner additive according to the present invention is an additive for an electrostatic image developing toner. The amount of the toner additive used is 1–20 parts by weight, and preferably 3–15 parts by weight per 100 parts by weight of binding resin. The amount used being 1–20 parts by weight, the toner additive realizes a toner which has excellent grindability, and at the same time is never overground. Accordingly, the grain size of the toner does not change drastically in the developing machine.

In the present invention, any known resin is usable as the binding resin. There may be enumerated, for example, polyester resin, styrene resin, styrene-(meth)acrylic resin, styrene-butadiene resin, epoxy resin, and polyurethane resin. The glass-transition temperature (Tg) of the binding resin is preferably in the range of 60–75° C. A toner having good preservation stability and low-temperature fixity can be obtained when Tg is in the range of 60–75° C. The preferable binding resin is polyester resin.

Coloring agents may be used as needed in the toner according to the present invention. Any known coloring agent or pigment can be used without particular limitation. There may be enumerated, for example, carbon black, oil black, graphite, nigrosine dyestuff, aniline blue, chrome yellow, ultramarine blue, du Pont-oil red, quinoline yellow, methylene blue chloride, phthalocyanine blue, malachite green oxalate, lamp black, rose bengal, C.I. pigment red 57:1, C.I. pigment red 122, C.I. pigment red 81:1, C.I. pigment yellow 12, C.I. pigment yellow 180, C.I. pigment yellow 17, C.I. pigment blue 15:1, and C.I. pigment blue 15:3. The desired color reproducibility and image stability can be obtained by blending these coloring agents or pigments.

In the magenta, yellow, cyan, or black toners according to the present invention, the preferable content of coloring agent is 0.5–15 parts by weight, and preferably 1–10 parts by weight per 100 parts by weight of binding resin. Good tinting strength and transparency are realized when the content of the coloring agent is 0.5–15 parts by weight.

The toner according to the present invention may be compounded with wax (mold release agent) so as to improve the anti-offset characteristic. As the wax for this purpose, any known wax may be used either each alone or in a combination. Commonly used waxes include aliphatic hydrocarbon waxes such as low-molecular-weight polyethylene, low-molecular-weight polypropylene, microcrystalline wax, parafin wax, and modified wax thereof; and fatty acid waxes such as carnauba wax, and montan acid ester wax.

Similarly, charge control agents, magnetic powder, and the like may be added as needed to the toner according to the present invention. Chrome azoic dye, iron azoic dye, aluminum azoic dye, salicylic acid metallic complex and the like may be used as charge control agents.

As the magnetic powder, known magnetic substances, for example, ferromagnetic metals such as cobalt, iron, and nickel; alloys of metals such as cobalt, iron, nickel, aluminum, lead, magnesium, zinc, and manganese; metallic oxides such as $Fe_3O_4$, $\gamma$-$Fe_2O_3$, and iron oxide containing cobalt; various ferrites such as MnZn ferrite and NiZn ferrite; magnetite and hematite, are preferably used. These substances are also preferably used after the surface thereof has been processed using surface treatment agents such as silane coupling agent, titanate coupling agent, and the like, or been given a polymer coating.

Other additives may be added as needed to the toner according to the present invention so as to improve its durability, fluidity, or cleaning ability for which there may be recited inorganic fine-powder of silica, titanium oxide, aluminum oxide, and the like; and micro particle resins such as pulverized fluororesin, micro particle polyethylene, pulverized acrylic resin, and the like.

The toner according to the present invention is manufactured by mixing said binding resin and toner additive with a mold release agent, coloring agent, charge control agent and so on as needed using a HENSCHEL mixer; by melting and kneading the mixture using a kneading machine such as an extruder; by cooling and then roughly grinding the mixed and kneaded material using a hammer crusher; by jet mill; by classifying it using a wind classifier; and by mixing it with a fluidizing agent using a HEHSCHEL mixer or the like.

The toner according to the present invention is used for a monocomponent type developer or for a two-component type developer. When it is used for a binary developer, a carrier is mixed therewith. As the carriers, known ones can be used, for which there may be recited ferrite, iron oxide powder, nickel or magnetic metal carrier, coated carriers which are the above substances coated with resin, or dispersion carrier of magnetic powder.

In the present invention, multicolor images are produced in the ordinary method using the color toners, for example, of cyan, magenta and yellow, with black toner as needed. Specifically, an unfixed image is formed as described below using a copying unit comprising an electrifying unit, an exposing means for each color, four developing units for supplying developer in each color onto a light-sensitive body, and a fixing unit: the light-sensitive body is electrified homogeneously; developing is performed using a toner of the first color; then the formation of electrostatic latent image and developing using a color toner for the second color and so on is repeated in the same manner sequentially; and the obtained toner images as toner layers in each color are superimposed on a transfer body to form the unfixed image. The desired multicolor image is formed by fixing the unfixed image using a fixing unit.

The electrostatic image developing toner containing the toner additive according to the present invention has excellent grindability in the purverizing process, does not fuse with the interior of the manufacturing equipment or the connecting piping, and has superior fixity. Additionally, the electrostatic image developing toner according to the present invention can form an excellent fixed color-image, having neither shortening the life of the developer owing to a fall in the electrostatic property caused when an additive is added thereto, nor causing a decline in low-temperature fixity.

As described above, since the electrostatic image developing toner additive according to the present invention comprises specific polymers or copolymers, it is possible to obtain a toner additive which realizes an electrostatic image developing toner having good grindability in the pulverizing process and consequently making it possible to reduce the grain size easily in a short time, which causes no fusion with the equipment. Moreover, the fundamental toner performances such as the electrostatic performance, fixing performance, and coloring performance are not affected by the toner additive.

As the electrostatic image developing toner according to the present invention comprises the toner additive, its grain size can be reduced easily in a short time due to its excellent grindability in the pulverizing process, and it will not fuse with the equipment. Thus, it can be manufactured with higher productivity at a lower cost, without causing any fall in the fundamental toner performances such as electrostatic performance, fixing performance, and coloring performance.

As the electrostatic image developer according to the present invention comprises the electrostatic image developing toner, it realizes images of higher quality at a lower manufacturing cost.

In the following, the present invention will be described in detail by way of Examples in the case of magenta. The cases of the cyan toner, yellow toner, and black toner are the same as the case of the magenta toner. Note that the present invention is not limited to these Examples.

The measuring methods used in each of the Examples and comparative examples are as follows:

Molecular weight: measured by the GPC method using tetrahydrofuran as the solvent;

Glass-transition temperature (Tg): measured by the DSC method, determining Tg as the temperature when the peak shoulder appears; and Softening point (Tm): measured by the ring and ball method stipulated in JIS K 2207.

EXAMPLE 1

(1) Production of Polyester

Terephthalic acid, ethylene oxide adduct of bisphenol A, and glycerin, at the ratio (by weight) of 45:40:4 respectively, were placed in a four-neck round-bottom flask equipped with a stainless steel agitator, a glass nitrogen gas inlet, and a condenser. The flask was set on a mantle heater. Then nitrogen gas was introduced through the inlet, and the temperature was raised while maintaining an atmosphere of inert gas inside of the flask. Next, 0.05 parts by weight of dibutyltin oxide to 100 parts by weight of the material mixture was added. The reactant was held at 200° C. and made to react for a predetermined time so as to obtain polyester resin (1) having the softening point and glass-transition temperature as shown below. This polyester resin (1) had these properties: softening point Tm=110° C., glass-transition temperature Tg=69° C., number average molecular weight Mn=4000, and weight average molecular weight Mw=11000.

(2) Preparation of Coloring Material

For 100 parts by weight of polyester resin (1) obtained in process (1) above, 100 parts by weight (50 parts by weight of solid) of pigment paste of C.I. pigment red 57:1 was mixed and kneaded in a kneader while heated. Phase shift of the pigment started at 90° C., and the water phase and colored resin phase were completely separated from each other at 130° C. After the water was removed from the kneader, mixing and kneading were continued so as to evaporate the residual moisture. Magenta coloring material (1) was obtained when the material became completely free of moisture and then was cooled.

(3) Preparation of Isopropenyl Toluene Homopolymer

A mixture of isopropenyl toluene and dehydrated and refined toluene (volume ratio: 1:1) and boron trifluoride phenolate complex diluted to ten times with dehydrated and refined toluene (1.7 times equivalent as phenol) were continuously fed into an autoclave having an actual capacity of 1270 ml equipped with mixing blades. The polymerization reaction was carried out at the reaction temperature of 5° C. The adopted feeding rate of the mixture of isopropenyl toluene and toluene was 1.0 liter/hour, and that of the diluted catalyst was 75 milliliters/hour. Next, the reactant mixture was transferred into the second stage autoclave so as to continue the polymerization reaction at 5° C. When the total residence time in the first and second stage autoclaves reached two hours, the reactant mixture was discharged continuously. When three times as much time as that of the residence time elapsed, one liter of the reactant mixture was sampled and the polymerization reaction was terminated. After the termination of polymerization, one normal NaOH aqueous solution was added to the sampled reactant mixture so as to deash the residual catalyst. The obtained reactant mixture was further washed five times using a large amount of water. Solvent and un-reacted monomers were removed by vacuum distillation in an evaporator to obtain isopropenyl toluene homopolymer (1). This isopropenyl toluene homopolymer (1) had these properties: softening point Tm=140° C., number average molecular weight Mn=1300, and weight average molecular weight Mw=2050.

(4) Preparation of Toner

Preparation of the toner was started by mixing 70 parts by weight of polyester resin (1) obtained in process (1) above as binding resin, 20 parts by weight of magenta coloring material (1) obtained in process (2) above, and 10 parts by weight of isopropenyl toluene homopolymer (1) obtained in process (3) above as toner additive; melting and kneading this mixture using an extruder; then roughly grinding the mixture using a cutter mill; and further pulverizing it using a pulverizer whernie jet streams were applied. The pulverized material obtained was classified using a wind classifier to get grains having an average grain size of 7 μm. Magenta toner was obtained by mixing 100 parts by weight of the grains with 0.8 parts by weight of particulate titanium oxide using a HENSCHEL mixer.

(5) Evaluation

The toner obtained in process (4) above was evaluated for grindability, fusion in the equipment, electrofication property, and fixing property. The results are shown in Table 1.

EXAMPLE 2

(1) Preparation of α-methyl Styrene Homopolymer

A mixture of α-methyl styrene and dehydrated and refined toluene (volume ratio: 1:1) and boron trifluoride phenolate complex diluted to ten times with dehydrated and refined toluene (1.7 times equivalent as phenol) were continuously fed into an autoclave having an actual capacity of 1270 ml equipped with mixing blades. The polymerization reaction was carried out at the reaction temperature of 5° C. The feeding rate of the mixture of α-methyl styrene and toluene was 1.0 liter/hour, and that of the diluted catalyst was 75 milliliters/hour. Next, the reactant mixture was transferred into the second stage autoclave so as to continue polymerization reaction at 5° C. When the total residence time in the first and second stage autoclaves reached two hours, the reactant mixture was discharged continuously. When three times as much time as that of the residence time elapsed, one liter of the reactant mixture was sampled and the polymerization reaction was terminated. After the termination of polymerization, one normal NaOH aqueous solution was added to the sampled reactant mixture so as to deash the residual catalyst. The obtained reactant mixture was further washed five times using a large amount of water. Solvent and un-reacted monomers were removed by vacuum distillation in an evaporator to obtain α-methyl styrene homopolymer (1). This α-methyl styrene homopolymer (1) had these properties: the softening point Tm=140° C., number average molecular weight Mn=1510, and weight average molecular weight Mw=2760.

(2) Preparation of Toner

Preparation of the toner was started by mixing 70 parts by weight of polyester resin (1) obtained in Example 1, 20 parts by weight of magenta coloring material (1) obtained in Example 1, and 10 parts by weight of α-methyl styrene homopolymer (1) obtained in process (1) above; melting and kneading this mixture using an extruder; then roughly grinding the mixture using a cutter mill; and further pulverizing it using a pulverizer wherein jet streams were applied. The pulverized material obtained was classified using a wind classifier to get grains having an average grain size of 7 μm. Magenta toner was obtained by mixing 100 parts by weight of the grains with 0.8 parts by weight of particulate titanium oxide using a HENSCHEL mixer. The results of evaluation of the toner are shown in Table 1.

EXAMPLE 3

(1) Preparation of Isopropenyl Toluene-α-methyl Styrene Copolymer

A mixture of isopropenyl toluene, α-methyl styrene, and dehydrated and refined toluene (volume ratio=total amount of monomers:toluene=1:1) and boron trifluoride phenolate complex diluted to ten times with dehydrated and refined toluene (1.7 times equivalent as phenol) were continuously fed into an autoclave having an actual capacity of 1270 ml equipped with mixing blades. The polymerization reaction was carried out at the reaction temperature of 5° C. The mol ratio of isopropenyl toluene to α-methyl styrene was 50:50. The feeding rate of the mixture of monomers and toluene was 1.0 liter/hour, and that of the diluted catalyst was 70 milliliters/hour. Next, the reactant mixture was transferred into the second stage autoclave so as to continue polymerization reaction at 5° C. When the total residence time in the first and second stage autoclaves reached two hours, the reactant mixture was discharged continuously. When three times as much time as that of the residence time elapsed, one liter of the reactant mixture was sampled and the polymerization reaction was terminated. After the termination of polymerization, one normal NaOH aqueous solution was added to the sampled reactant mixture so as to deash the residual catalyst. The obtained reactant mixture was further washed five times using a large amount of water. Solvent and un-reacted monomers were removed by vacuum distillation in an evaporator to obtain isopropenyl toluene-α-methyl styrene copolymer (1). This isopropenyl toluene-α-methyl styrene copolymer (1) had these properties: softening point Tm=145° C., number average molecular weight Mn=1420, and weight average molecular weight Mw=2430.

(2) Preparation of Toner

Preparation of the toner was started by mixing 70 parts by weight of polyester resin (1) obtained in Example 1, 20 parts by weight of magenta coloring material (1) obtained in Example 1, and 10 parts by weight of isopropenyl toluene-α-methyl styrene copolymer (1) obtained in process (1)

above; melting and kneading this mixture using an extruder; then roughly grinding the mixture using a cutter mill; and further pulverizing it using a pulverizer wherein jet streams were applied. The pulverized material obtained was classified using a wind classifier to get grains having an average grain size of 7 μm. Magenta toner was obtained by mixing 100 parts by weight of the grains with 0.8 parts by weight of particulate titanium oxide using a Henschel mixer. The results of evaluation of the toner are shown in Table 1.

EXAMPLE 4

(1) Preparation of α-methyl Styrene-styrene Copolymer

A mixture of α-methyl styrene, styrene, and dehydrated and refined toluene (volume ratio=total amount of monomers:toluene=1:1) and boron trifluoride phenolate complex diluted to ten times with dehydrated and refined toluene (1.7 times equivalent as phenol) were continuously fed into an autoclave having an actual capacity of 1270 ml equipped with mixing blades. The polymerization reaction was carried out at the reaction temperature of 5° C. The mol ratio of α-methyl styrene to styrene was 60:40. The feeding rate of the mixture of monomers and toluene was 1.0 liter/hour, and that of the diluted catalyst was 90 milliliters/hour. Next, the reactant mixture was transferred into the second stage autoclave so as to continue polymerization reaction at 5° C. When the total residence time in the first and second stage autoclaves reached two hours, the reactant mixture was discharged continuously. When three times as much time as that of the residence time elapsed, one liter of the reactant mixture was sampled and the polymerization reaction was terminated. After the termination of polymerization, one normal NaOH aqueous solution was added to the sampled reactant mixture so as to deash the residual catalyst. The obtained reactant mixture was further washed five times using a large amount of water. Solvent and un-reacted monomers were removed by vacuum distillation in an evaporator to obtain α-methyl styrene-styrene copolymer (1). This α-methyl styrene-styrene copolymer (1) had these properties: softening point Tm=123° C., number average molecular weight Mn=1500, and weight average molecular weight Mw=2590.

(2) Preparation of Toner

Preparation of the toner was started by mixing 70 parts by weight of polyester resin (1) obtained in Example 1, 20 parts by weight of magenta coloring material (1) obtained in Example 1, and 10 parts by weight of α-methyl styrene-styrene copolymer (1) obtained in process (1) above; melting and kneading this mixture using an extruder; then roughly grinding the mixture using a cutter mill; and further pulverizing it using a pulverizer wherein jet streams were applied. The pulverized material obtained was classified using a wind classifier to get grains having an average grain size of 7 μm. Magenta toner was obtained by mixing 100 parts by weight of the grains with 0.8 parts by weight of particulate titanium oxide using a HENSCHEL mixer. The results of evaluation of the toner are shown in Table 1.

EXAMPLE 5

(1) Preparation of α-methyl Styrene-styrene Copolymer

A mixture of α-methyl styrene, styrene, and dehydrated and refined toluene (volume ratio=total amount of monomers:toluene=1:1) and boron trifluoride phenolate complex diluted to ten times with dehydrated and refined toluene (1.7 times equivalent as phenol) were continuously fed into an autoclave having an actual capacity of 1270 ml equipped with mixing blades. The polymerization reaction was carried out at the reaction-temperature of 5° C. The mol ratio of α-methyl styrene to styrene was 80:20. The feeding rate of the mixture of monomers and toluene was 1.0 liter/hour, and that of the diluted catalyst was 90 milliliters/hour. Next, the reactant mixture was transferred into the second stage autoclave so as to continue polymerization at 5° C. When the total residence time in the first and second stage autoclaves reached two hours, the reactant mixture was discharged continuously. When three times as much time as that of the residence time elapsed, one liter of the reactant mixture was sampled and the polymerization reaction was terminated. After termination of polymerization, one normal NaOH aqueous solution was added to the sampled reactant mixture so as to deash the residual catalyst. The obtained reactant mixture was further washed five times using a large amount of water. Solvent and un-reacted monomers were removed by vacuum distillation in an evaporator to obtain α-methyl styrene-styrene copolymer (2). This α-methyl styrene-styrene copolymer (2) had these properties: softening point Tm=120° C., number average molecular weight Mn=1100, and weight average molecular weight Mw=1930.

(2) Preparation of Toner

Preparation of the toner was started by mixing 70 parts by weight of polyester resin (1) obtained in Example 1, 20 parts by weight of magenta coloring material (1) obtained in Example 1, and 10 parts by weight of α-methyl styrene-styrene copolymer (2) obtained in process (1) above; melting and kneading this mixture using an extruder; roughly grinding the mixture using a cutter mill; and further pulverizing it using a pulverizer wherein jet streams were applied. The pulverized material obtained was classified using a wind classifier to get grains having an average grain size of 7 μm. Magenta toner was obtained by mixing 100 parts by weight of the grains with 0.8 parts by weight of particulate titanium oxide using a HENSCHEL mixer. The results of evaluation of the toner are shown in Table 1.

EXAMPLE 6

(1) Preparation of α-methyl Styrene-styrene Copolymer

A mixture of α-methyl styrene, styrene, and dehydrated and refined toluene (volume ratio=total amount of monomers:toluene=1:1) and boron trifluoride phenolate complex diluted to ten times with dehydrated and refined toluene (1.7 times equivalent as phenol) were continuously fed into an autoclave having an actual capacity of 1270 ml equipped with mixing blades. The polymerization reaction was carried out at the reaction temperature of 5° C. The mol ratio of α-methyl styrene to styrene was 60:40. The feeding rate of the mixture of monomers and toluene was 1.0 liter/hour, and that of the diluted catalyst was 75 milliliters/hour. Next, the reactant mixture was transferred into the second stage autoclave so as to continue polymerization at 5° C. When the total residence time in the first and second stage autoclaves reached two hours, the reactant mixture was discharged continuously. When three times as much time as that of the residence time elapsed, one liter of the reactant mixture was sampled and the polymerization reaction was terminated. After termination of polymerization, one normal NaOH aqueous solution was added to the sampled reactant mixture so as to deash the residual catalyst. The obtained reactant mixture was further washed five times using a large amount of water. Solvent and un-reacted monomers were removed by vacuum distillation in an evaporator to obtain α-methyl styrene-styrene copolymer (3). This α-methyl styrene-styrene copolymer (3) had these properties: softening point Tm=140° C., number average molecular weight Mn=1870, and weight average molecular weight Mw=3230.

(2) Preparation of Toner

Preparation of the toner was started by mixing 70 parts by weight of polyester resin (1) obtained in Example 1, 20 parts by weight of magenta coloring material (1) obtained in Example 1, and 10 parts by weight of α-methyl styrene-styrene copolymer (3) obtained in process (1) above; melting and kneading this mixture using an extruder; roughly grinding the mixture using a cutter mill; and further pulverizing it using a pulverizer wherein jet streams were applied. The pulverized material obtained was classified using a wind classifier to get grains having an average grain size of 7 μm. Magenta toner was obtained by mixing 100 parts by weight of the grains with 0.8 parts by weight of particulate titanium oxide using a HENSCHEL mixer. The results of evaluation of the toner are shown in Table 1.

COMPARATIVE EXAMPLE 1

(1) Preparation of Isopropenyl Toluene-C5 Fraction Copolymer Resin

A mixture of isopropenyl toluene, C5 fraction obtained by thermal decomposition of petroleum naphtha, and dehydrated and refined toluene (volume ratio=total amount of monomers:toluene=1:1) and boron trifluoride phenolate complex diluted to ten times with dehydrated and refined toluene (1.7 times equivalent as phenol) were continuously fed into an autoclave having an actual capacity of 1270 ml equipped with mixing blades. The polymerization reaction was carried out at the reaction temperature of 5° C. The weight ratio of isopropenyl toluene to C5 fraction was 90:10. The feeding rate of the mixture of monomers and toluene was 1.0 liter/hour, and that of the diluted catalyst was 80 milliliters/hour. Next, the reactant mixture was transferred into the second stage autoclave so as to continue polymerization at 5° C. When the total residence time in the first and second stage autoclaves reached two hours, the reactant mixture was discharged continuously. When three times as much time as that of the residence time elapsed, one liter of the reactant mixture was sampled and the polymerization reaction was terminated. After termination of polymerization, one normal NaOH aqueous solution was added to the sampled reactant mixture so as to deash the residual catalyst. The obtained reactant mixture was further washed five times using a large amount of water. Solvent and un-reacted monomers were removed by vacuum distillation in an evaporator to obtain isopropenyl toluene-C5 fraction copolymer (1). This isopropenyl toluene-C5 fraction copolymer (1) had these properties: softening point Tm=130° C., number average molecular weight Mn=1170, and weight average molecular weight Mw=2010.

(2) Preparation of Toner

Preparation of the toner was started by mixing 70 parts by weight of polyester resin (1) obtained in Example 1 with 20 parts by weight of magenta coloring material (1) obtained in Example 1, and 10 parts by weight of isopropenyl toluene-C5 fraction copolymer (1) obtained in process (1) above; melting and kneading this mixture using an extruder; roughly grinding the mixture using a cutter mill; and further pulverizing it using a pulverizer wherein jet streams were applied. The pulverized material obtained was classified using a wind classifier to get grains having an average grain size of 7 μm. Magenta toner was obtained by mixing 100 parts by weight of the grains with 0.8 parts by weight of particulate titanium oxide using a HENSCHEL mixer. The results of evaluation of the toner are shown in Table 1.

COMPARATIVE EXAMPLE 2

(1) Preparation of Isopropenyl Toluene-α-methyl Styrene-C5 Fraction Copolymer Resin A mixture of isopropenyl toluene, α-methyl styrene, C5 fraction obtained by thermal decomposition of petroleum naphtha, and dehydrated and refined toluene (volume ratio=total amount of monomers:toluene=1:1) and boron trifluoride phenolate complex diluted to ten times with dehydrated and refined toluene (1.7 times equivalent as phenol) were continuously fed into an autoclave having an actual capacity of 1270 ml equipped with mixing blades. The polymerization reaction was carried out at the reaction temperature of 5° C. The weight ratio of isopropenyl toluene to α-methyl styrene to C5 fraction was 45:45:10. The feeding rate of the mixture of monomers and toluene was 1.0 liter/hour, and that of the diluted catalyst was 90 milliliters/hour. Next, the reactant mixture was transferred into the second stage autoclave so as to continue polymerization reaction at 5° C. When the total residence time in the first and second stage autoclaves reached two hours, the reactant mixture was discharged continuously. When three times as much time as that of the residence time elapsed, one liter of the reactant mixture was sampled and the polymerization reaction was terminated. After termination of polymerization, one normal NaOH aqueous solution was added to the sampled reactant mixture so as to deash residual catalyst. The obtained reactant mixture was further washed five times using a large amount of water. Solvent and un-reacted monomers were removed by vacuum distillation in an evaporator to obtain isopropenyl toluene-α-methyl styrene-C5 fraction copolymer (1). This isopropenyl toluene-α-methyl styrene-C5 fraction copolymer (1) had these properties: softening point Tm=125° C., number average molecular weight Mn=1290, and weight average molecular weight Mw=2140.

(2) Preparation of Toner

Preparation of the toner was started by mixing,70 parts by weight of polyester resin (1) obtained in Example 1 with 20 parts by weight of magenta coloring material (1) obtained in Example 1, and 10 parts by weight of isopropenyl toluene-α-methyl styrene-C5 fraction copolymer (1) obtained in process (1) above; melting and kneading this mixture using an extruder; roughly grinding the mixture using a cutter mill; and further pulverizing it using a pulverizer wherein jet streams were applied. The pulverized material obtained was classified using a wind classifier to get grains having an average grain size of 7 μm. Magenta toner was obtained by mixing 100 parts by weight of the grains with 0.8 parts by weight of particulate titanium oxide using a HENSCHEL mixer. The results of evaluation of the toner are shown in Table 1.

COMPARATIVE EXAMPLE 3

(1) Preparation of Isopropenyl Toluene Homopolymer

A mixture of isopropenyl toluene and dehydrated and refined toluene (volume ratio=1:1) and boron trifluoride phenolate complex diluted to ten times with dehydrated and refined toluene (1.7 times equivalent as phenol) were continuously fed into an autoclave having an actual capacity of 1270 ml equipped with mixing blades. The polymerization reaction was carried out at the reaction temperature of 5° C. The feeding rate of the mixture of isopropenyl toluene and toluene was 1.0 liter/hour, and that of the diluted catalyst was 90 milliliters/hour. Next, the reactant mixture was transferred into the second stage autoclave so as to continue polymerization reaction at 5° C. When the total residence time in the first and second stage autoclaves reached two hours, the reactant mixture was discharged continuously. When three times as much time as that of the residence time elapsed, one liter of the reactant mixture was sampled and the polymerization reaction was terminated. After termination of polymerization, one normal NaOH aqueous solution was added to the sampled reactant mixture so as to deash the residual catalyst. The obtained reactant mixture was further washed five times using a large amount of water. Solvent and un-reacted monomers were removed by vacuum distillation in an evaporator to obtain isopropenyl toluene homopolymer (2). This isopropenyl toluene homopolymer (2) had these properties: softening point Tm=120° C., number average molecular weight Mn=1060, and weight average molecular weight Mw=1600.

(2) Preparation of Toner

Preparation of the toner was started by mixing 70 parts by weight of polyester resin (1) obtained in Example 1 with 20 parts by weight of magenta coloring material (1) obtained in Example 1, and 10 parts by weight of isopropenyl toluene homopolymer (2) obtained in process (1) above; melting and kneading this mixture using an extruder; roughly grinding the mixture using a cutter mill; and further pulverizing it using a pulverizer wherein jet streams were applied. The pulverized material obtained was classified using a wind classifier to get grains having an average grain size of 7 $\mu$m. Magenta toner was obtained by mixing 100 parts by weight of the grains with 0.8 parts by weight of particulate titanium oxide using a HENSCHEL mixer. The results of evaluation of the toner are shown in Table 1.

COMPARATIVE EXAMPLE 4

(1) Preparation of α-methyl Styrene Homopolymer

A mixture of α-methyl styrene and dehydrated and refined toluene (volume ratio=1:1) and boron trifluoride phenolate complex diluted to ten times with dehydrated and refined toluene (1.7 times equivalent as phenol) were continuously fed into an autoclave having an actual capacity of 1270 ml equipped with mixing blades. The polymerization reaction was carried out at the reaction temperature of 5° C. The feeding rate of the mixture of α-methyl styrene and toluene was 1.0 liter/hour, and that of the diluted catalyst was 90 milliliters/hour. Next, the reactant mixture was transferred into the second stage autoclave so as to continue polymerization reaction at 5° C. When the total residence time in the first and second stage autoclaves reached two hours, the reactant mixture was discharged continuously. When three times as much time as that of the residence time elapsed, one liter of the reactant mixture was sampled and the polymerization reaction was terminated. After termination of polymerization, one normal NaOH water solution was added to the sampled reactant mixture so as to deash residual catalyst. The obtained reactant mixture was further washed five times using a large amount of water. Solvent and un-reacted monomer were removed by vacuum distillation in an evaporator to obtain α-methyl styrene homopolymer (2). This α-methyl styrene homopolymer (2) had these properties: softening point Tm=120° C., number average molecular weight Mn=1300, and weight average molecular weight Mw=2320.

(2) Preparation of Toner

Preparation of the toner was started by mixing 70 parts by weight of polyester resin (1) obtained in Example 1 with 20 parts by weight of magenta coloring material (1) obtained in Example 1, and 10 parts by weight of α-methyl styrene homopolymer (2) obtained in process (1) above; melting and kneading this mixture using an extruder; roughly grinding the mixture using a cutter mill; and further pulverizing it using a pulverizer wherein jet streams were applied. The pulverized material obtained was classified using a wind classifier to get grains having an average grain size of 7 $\mu$m. Magenta toner was obtained by mixing 100 parts by weight of the grains with 0.8 parts by weight of particulate titanium oxide using a HENSCHEL mixer. The results of evaluation of the toner are shown in Table 1.

TABLE 1

| | Grindability *1 | Fusion to the interior of equipment *2 | Electro-static property *3 | Fixing property *4 | Overall evaluation *5 |
|---|---|---|---|---|---|
| Example 1 | ◎ | ○ | ○ | ◎ | ○ |
| Example 2 | ◎ | ○ | ○ | ◎ | ○ |
| Example 3 | ◎ | ○ | ○ | ◎ | ○ |
| Example 4 | ◎ | ○ | ○ | ◎ | ○ |
| Example S | ◎ | ○ | ○ | ◎ | ○ |
| Example 6 | ◎ | ○ | ○ | ◎ | ○ |
| Comparative example 1 | ○ | ○ | X | ◎ | X |
| Comparative example 2 | ○ | ○ | X | ◎ | X |
| Comparative example 3 | ○ | ○ | X | ◎ | X |
| Comparative example 4 | ○ | ○ | X | ◎ | X |

*1 Grindability: Comparison of amounts of roughly ground material supplied per unit of time for obtaining one grain size steadily when a magenta toner is pulverized to a uniform grain size using a pulverizer wherein jet streams are applied.
◎: 5 kg/hour or more
○: 4 kg/hour or more-less than 5 kg/hour
Δ: 3 kg/hour or more-less than 4 kg/hour
X: less than 3 kg/hour
*2 Fusion to the interior of equipment: Comparison of the weight of toner fused to protruding parts inside of the pulverizer when a given amount of magenta toner is pulverized to a uniform grain size using a pulverizer wherein jet streams are applied.
○: less than 100 mg
Δ: 100 mg or more-less than 200 mg
X: 200 mg or more
*3 Electrostatic property: A developer was prepared by mixing iron powder as carrier, which was coated with acrylic resin containing fluorine and had an average grain size of 50 $\mu$m, with a magenta toner so as to make the toner concentration 8% by weight. Using this developer, the decline in electrostatic property was compared after developing 50,000 copies, using the developing unit of a copying machine (A-COLOR, manufactured by Fuji-Xerox Co. Ltd., trademark). The proportion of electrification amount after developing 50,000 copies to the initial electrification amount is classified as follows:
○: 0.8 or more
Δ: 0.7 or more-less than 0.8
X: less than 0.7
*4 Fixing property: An image was fixed by: using the above developer; transcribing an image developed from a test image onto the transfer paper; and fixing it using a fixing roller, the surface of which was formed of polytetrafluoroethylene (manufactured by du Pont and Co.), and a fixing roller, the surface of which was formed of silicone rubber (KE-1300RTV, manufactured by Shin-etsu Kagaku Co. Ltd., trademark), while maintaining the temperature of fixing rollers at 200° C.. The fixed image obtained was then rubbed five times using a sand eraser having a base of 15 mm × 7.5 mm with a load of 500 g thereon. Before and after this process, the optical reflection density was measured using a reflection densitometer from Macbeth Co. Ltd. The fixity of a fixed image was calculated according to the following formula, and evaluated on the basis of the following standard:
Fixity (%) = (image density after test)/(image density before test) × 100
◎: 90% or more
○: 80% or more-less than 90%
Δ: 50% or more-less than 80%
X: less than 50%
*5 Overall evaluation
○: good
Δ: usable
X: unusable

INDUSTRIAL APPLICATION

The present invention makes it possible to: obtain a toner additive which realizes an electrostatic image developing toner, the superb grindability of which in the pulverizing process makes it easy to reduce its grain size in a short time, and which, causes no fusion with the equipment, and moreover does not affect the fundamental toner performances such as electrostatic performance, fixing performance, coloring performance and the like; and obtain an electrostatic image developing toner and an electrostatic image developer, both containing the toner additive. Therefore, the toner additive, toner and electrostatic image developer of the present invention is suitable for use in the electrographic method, in the electrostatic recording method, or in the electrostatic printing method.

What is claimed is:

1. An electrostatic image developing toner comprising:

1–20 parts by weight of a toner additive and 100 parts by weight of binding resin wherein the toner additive comprises a copolymer comprising styrene and at least one monomer selected from the group consisting of vinyltoluene, α-methylstyrene and isopropenyltoluene and having a ring and ball softening point of 110–170° C.

2. The electrostatic image developing toner of claim 1, wherein the binding resin is polyester resin.

3. An electrostatic image developer comprising at least one toner and one carrier, wherein said toner is the electrostatic image developing toner of claim 2.

4. The electrostatic image developer of claim 3, wherein the carrier has a resin coating layer.

5. An electrostatic image developer comprising at least one toner and one carrier, wherein said toner is the electrostatic image developing toner of claim 1.

6. The electrostatic image developer of claim 5, wherein the carrier has a resin coating layer.

7. A method for reducing grain size of an electrostatic image developing toner comprising a binder resin, comprising, mixing the binder resin with a toner additive comprising a copolymer comprising styrene and at least one monomer selected from the group consisting of vinyltoluene, α-methyl styrene and isopropenyl toluene, and having a ring and ball softening point of 110–170° C., and pulverizing the mixture.

8. A method for reducing grain size of an electrostatic image developing toner as claimed in claim 7, wherein 1–20 parts by weight of the toner additive are mixed with 100 parts by weight of the binder resin.

9. A method for reducing grain size of an electrostatic image developing toner as claimed in claim 7, wherein the binding resin is polyester resin.

10. A method for producing an electrostatic image developing toner, comprising, mixing a binder resin with a toner additive comprising a copolymer comprising styrene and at least one monomer selected from the group consisting of vinyltoluene, α-methyl styrene and isopropenyl toluene, and having a ring and ball softening point of 110–170° C., melting and kneading the mixture, and pulverizing the mixed and kneaded mixture.

11. A method for producing an electrostatic image developing toner as claimed in claim 10, wherein 1–20 parts by weight of the toner additive are mixed with 100 parts by weight of the binder resin.

12. A method for producing an electrostatic image developing toner as claimed in claim 10, wherein the binding resin is polyester resin.

* * * * *